US008662411B2

(12) United States Patent
Gruenberger

(10) Patent No.: US 8,662,411 B2
(45) Date of Patent: Mar. 4, 2014

(54) FUEL INJECTION VALVE FOR INTERNAL COMBUSTION ENGINES

(75) Inventor: Andreas Gruenberger, Spraitbach (DE)

(73) Assignee: Robert Bosch GmbH, Stuttgart (DE)

( * ) Notice: Subject to any disclaimer, the term of this patent is extended or adjusted under 35 U.S.C. 154(b) by 646 days.

(21) Appl. No.: 12/736,635

(22) PCT Filed: Feb. 4, 2009

(86) PCT No.: PCT/EP2009/051244
§ 371 (c)(1),
(2), (4) Date: Nov. 22, 2010

(87) PCT Pub. No.: WO2009/130065
PCT Pub. Date: Oct. 29, 2009

(65) Prior Publication Data

US 2011/0088660 A1 Apr. 21, 2011

(30) Foreign Application Priority Data

Apr. 23, 2008 (DE) ..... 10 2008 001 330

(51) Int. Cl.
*F02M 47/02* (2006.01)

(52) U.S. Cl.
USPC ..... 239/88; 239/533.2

(58) Field of Classification Search
USPC ..... 123/445, 467, 468, 506, 508, 514; 239/533.2, 533.8, 88, 92
See application file for complete search history.

(56) References Cited

U.S. PATENT DOCUMENTS

| | | | | |
|---|---|---|---|---|
| 5,012,785 | A * | 5/1991 | Long et al. | 123/467 |
| 5,641,121 | A * | 6/1997 | Beck et al. | 239/92 |
| 5,823,429 | A * | 10/1998 | Beck et al. | 239/5 |
| 6,971,587 | B2 * | 12/2005 | Boehland et al. | 239/88 |
| 6,988,679 | B2 * | 1/2006 | Mattes | 239/533.2 |
| 7,051,958 | B2 * | 5/2006 | Sander-Potz et al. | 239/533.2 |
| 7,121,476 | B2 * | 10/2006 | Buehler et al. | 239/88 |
| 7,320,310 | B2 * | 1/2008 | Eisenmenger et al. | 123/446 |
| 7,575,180 | B2 * | 8/2009 | Baranowski et al. | 239/5 |

(Continued)

FOREIGN PATENT DOCUMENTS

| | | | |
|---|---|---|---|
| CN | 101061308 | | 10/2007 |
| EP | 1733139 | B1 | 3/2008 |
| WO | 2005019638 | A1 | 3/2005 |
| WO | WO2007098986 | A1 | 9/2007 |

*Primary Examiner* — Stephen K Cronin
*Assistant Examiner* — Joseph Dallo
(74) *Attorney, Agent, or Firm* — Michael Best & Friedrich LLP

(57) ABSTRACT

A fuel injection valve includes a nozzle needle interacting with a valve seat by longitudinal movements thereof, thus opening/closing an injection opening. The nozzle needle undergoes a locking force toward the valve seat pressure in a control space. A control valve adjusts pressure in the control space. The control valve has a control valve space connected to the control space, in which a control valve member is disposed longitudinally movably, and opens and closes a connection of the control valve space to a leakage oil space by longitudinal movement. The control valve member is surrounded by pressure in the control valve space and configured such that no or very little resulting hydraulic force acts upon the control valve member in the movement direction by the pressure in the control space, if the control valve member closes the connection of the control valve space to the leakage oil space.

20 Claims, 4 Drawing Sheets

(56) References Cited

U.S. PATENT DOCUMENTS

2002/0104901 A1* 8/2002 Kunzi et al. ..... 239/533.2
2004/0155123 A1* 8/2004 Baranowski et al. ..... 239/533.2
2006/0243252 A1* 11/2006 Eisenmenger et al. ..... 123/447
2007/0001032 A1 1/2007 Boecking
2007/0221177 A1 9/2007 Magel
2008/0296411 A1* 12/2008 Heinz et al. ..... 239/533.2

* cited by examiner

FUEL INJECTION VALVE FOR INTERNAL COMBUSTION ENGINES

CROSS-REFERENCE TO RELATED APPLICATION

This application is a 35 USC 371 application of PCT/EP2009/051244 filed on Feb. 4, 2009.

BACKGROUND OF THE INVENTION

1. Field of the Invention

The invention relates to a fuel injection valve for internal combustion engines, of the kind used for injecting fuel into the combustion chamber of an internal combustion engine.

2. Description of the Prior Art

Fuel injection valves, of the kind preferably used for injecting fuel directly into the combustion chamber of an internal combustion engine, have long been known from the prior art. In injection systems that operate on the so-called common rail principle, fuel compressed by means of a high-pressure pump is made available in a so-called rail and injected by means of injectors into the various combustion chambers of an internal combustion engine. The injection is triggered by means of a nozzle needle, which executes a longitudinal motion and thereby opens and closes one or more injection openings. Since in the injection of fuel at high pressure, in particular, it is not sensible or is impossible to move the nozzle needle directly by means of an electrical actuator, hydraulic forces that the compressed fuel exerts on the nozzle needle are employed for the triggering. For that purpose, a control chamber is embodied in the fuel injection valve, and the force of the control chamber acts directly or indirectly on the nozzle needle and presses it thereby against a nozzle seat, so that the nozzle needle closes the injection openings. By varying the pressure in the control chamber and thus the closing force on the nozzle needle, the longitudinal motion of the nozzle needle can be controlled in a purposeful way.

The fuel pressure in the control chamber is varied by means of a control valve; the control chamber is made to communicate in alternation with a leak fuel chamber, in which a low pressure prevails, or this communication is interrupted by means of the control valve. From German Patent Disclosure DE 10 2004 030 445 A1, a fuel injection valve is known which has a control valve of this kind. The control valve is embodied there as a so-called 3/2-way valve, and it controls the communication of the control chamber on the one hand with the high-pressure source, from which the compressed fuel is delivered to the injection valve, and on the other to a leak fuel chamber that has low pressure. The control valve has a control valve member, which can be moved inside the control valve chamber by means of an electrical actuator, such as a magnet or piezoelectric actuator, and thus cooperates with a first control valve seat and a second control valve seat. If the control valve member is in contact with the first control valve seat, then the communication of the control valve chamber with the leak fuel chamber or to a leak fuel connection that has a communication with a low-pressure region is closed. Since both the outlet throttle restriction, which from the control chamber of the nozzle needle discharges into the control valve chamber, and the bypass throttle restriction, which connects the high-pressure conduit to the control conduit, open into the control valve chamber, the result is communication of the high-pressure conduit with the control chamber via the outlet throttle restriction.

If the pressure is to be lowered in the control chamber, then by means of the electrical actuator the control valve member is moved away from the first control valve seat into contact with the second control valve seat. As a result, the communication of the control valve chamber with the leak fuel chamber is opened, while simultaneously the bypass throttle restriction, which connects the high-pressure conduit with the control valve chamber, is closed. The resultant communication of the outlet throttle restriction from the control chamber with the leak fuel chamber via the control valve chamber leads to an outflow of the fuel pressure in the control chamber and thus to a corresponding pressure reduction, which leads to a lowering of the closing pressure on the nozzle needle and finally to a motion of the nozzle needle away from the nozzle seat and for opening the injection openings.

A control valve that functions quite similarly is further known from International Patent Disclosure WO 2006/067015 A1, which functions essentially in the same way. Once again, the control valve member is surrounded by the fuel pressure of the control valve chamber and thus is acted upon on all sides by the fuel pressure of the control valve chamber. The control valve functions as described above, in such a way that initially, the control valve member is in contact with the first control valve seat and is moved by an electrical actuator into the control valve chamber, until it is in contact with the second control valve seat. The control valve member has to be moved away from the first control valve seat counter to the fuel pressure in the control valve chamber. Since initially, at least approximately the same pressure as in the control chamber of the nozzle needle prevails in the control valve chamber, and this pressure in turn is approximately equivalent to the fuel high pressure supplied, this force is quite strong, so that a suitably powerful actuator with suitably high capacity is a prerequisite.

Moreover, the known control valves have the disadvantage that the control valve member is prestressed toward the first control valve seat by a strong spring. This is necessary to ensure reliable closure of the control valve even whenever the hydraulic forces on the control valve member vary sharply because of the motion of the control valve member in the control valve chamber. However, a very strong closing spring has the disadvantage that the control valve member, even at relatively slight injection pressures, or in other words whenever only a slight fuel pressure prevails in the control valve chamber, is pressed against the first control valve seat by the very strong spring. The result is unnecessarily high wear at the first control valve seat, which can adversely affect the service life of the fuel injection valve.

ADVANTAGES AND SUMMARY OF THE INVENTION

The fuel injection valve of the invention has the advantage over the prior art that fast, reliable switching of the injection is made possible by means of a control valve, and thus higher-quality injection and a longer service life of the injection valve are made possible. To that end, the control valve member, which is located in the control valve chamber, is embodied such that by the pressure in the control chamber, no resultant hydraulic force in the direction of the longitudinal motion of the control valve member is exerted. By this embodiment, the control valve member, when it is in contact with the first control valve seat, or in other words is in its closing position, is actually or practically force-balanced with respect to the leak fuel chamber. This makes it possible, by, means of a relatively weak actuator, to move the control valve member quickly in the control valve chamber and to perform very fast switching operations. Since the control valve member is practically force-balanced, a relatively weak closing spring also suffices, which spring ensures that the control valve member, in the absence of further forces, and especially whenever the electrical actuator with which the control valve member is moved is off, remains in its position at the first control valve seat in which it closes the leak fuel chamber off from the control valve chamber.

In a first advantageous feature, the control valve member is embodied in pistonlike fashion and cooperates with a first control valve seat for opening and closing a communication of the control valve chamber with the leak fuel chamber. The control valve member is guided, on its end remote from the control valve seat, in a sleeve. It is ensured by means of the sleeve that the end of the control valve member on the far side from the first control valve seat is not acted upon by the fuel pressure of the control valve chamber; instead, besides the outer surfaces of the control valve member, only the region with which the control valve member cooperates with the first control valve seat is acted on by the fuel pressure. If the diameter of the control valve member, in the region that is guided in the sleeve, is the same size as the diameter of the seat region in the vicinity of the first control valve seat, then, whenever the control valve member is in contact with the first control valve seat, no resultant hydraulic forces act on the control valve member, so that the control valve member is force-balanced.

To ensure the movability of the control valve member, the chamber that is defined by the sleeve and the control valve member is a low-pressure chamber, which is pressure-relieved at all times. Advantageously, the low-pressure chamber communicates with the leak fuel chamber, in which a low pressure prevails at all times.

The spring with which the control valve member is pressed against the first control valve seat is advantageously disposed between the sleeve and the control valve member in pressure-prestressed fashion, so that on the one hand, the control valve member is pressed against the first control valve seat, and on the other, the sleeve is pressed against the control valve chamber wall on the far site from the first control valve seat.

In a further advantageous feature, the control valve member is embodied in boltlike form and has a blind bore, which originates at the end of the control valve member opposite from the first control valve seat, or in other words is open on the far side from the first control valve seat. An inner sleeve is disposed in sealing fashion in the blind bore, so that by means of the control valve member and the inner sleeve, a low-pressure chamber is defined which in turn advantageously communicates with a low-pressure chamber, preferably the leak fuel chamber, via a longitudinal bore extending in the inner sleeve. In this arrangement, the closing spring can be disposed in the interior of the low-pressure chamber, that is, between the inner guide sleeve and the control valve member, in pressure-prestressed fashion, so that the closing spring is not acted upon directly by the fuel pressure of the control valve chamber.

In a further advantageous feature, the control valve chamber can be made to communicate with the fuel high pressure-carrying region of the fuel injection valve via a bypass throttle restriction. The bypass throttle restriction is disposed such that whenever the control valve member slides from the first control valve seat into the second control valve seat, the bypass throttle restriction is closed, while whenever the control valve member is in contact with the first control valve seat, the bypass throttle restriction ensures a rapid pressure buildup in the control valve chamber and thus also in the control chamber of the nozzle needle.

BRIEF DESCRIPTION OF THE DRAWINGS

In the drawings, various exemplary embodiments of the fuel injection valve of the invention are shown. The invention is described below in conjunction with the drawing, in which.

DESCRIPTION OF THE PREFERRED EMBODIMENTS

Figure 1:
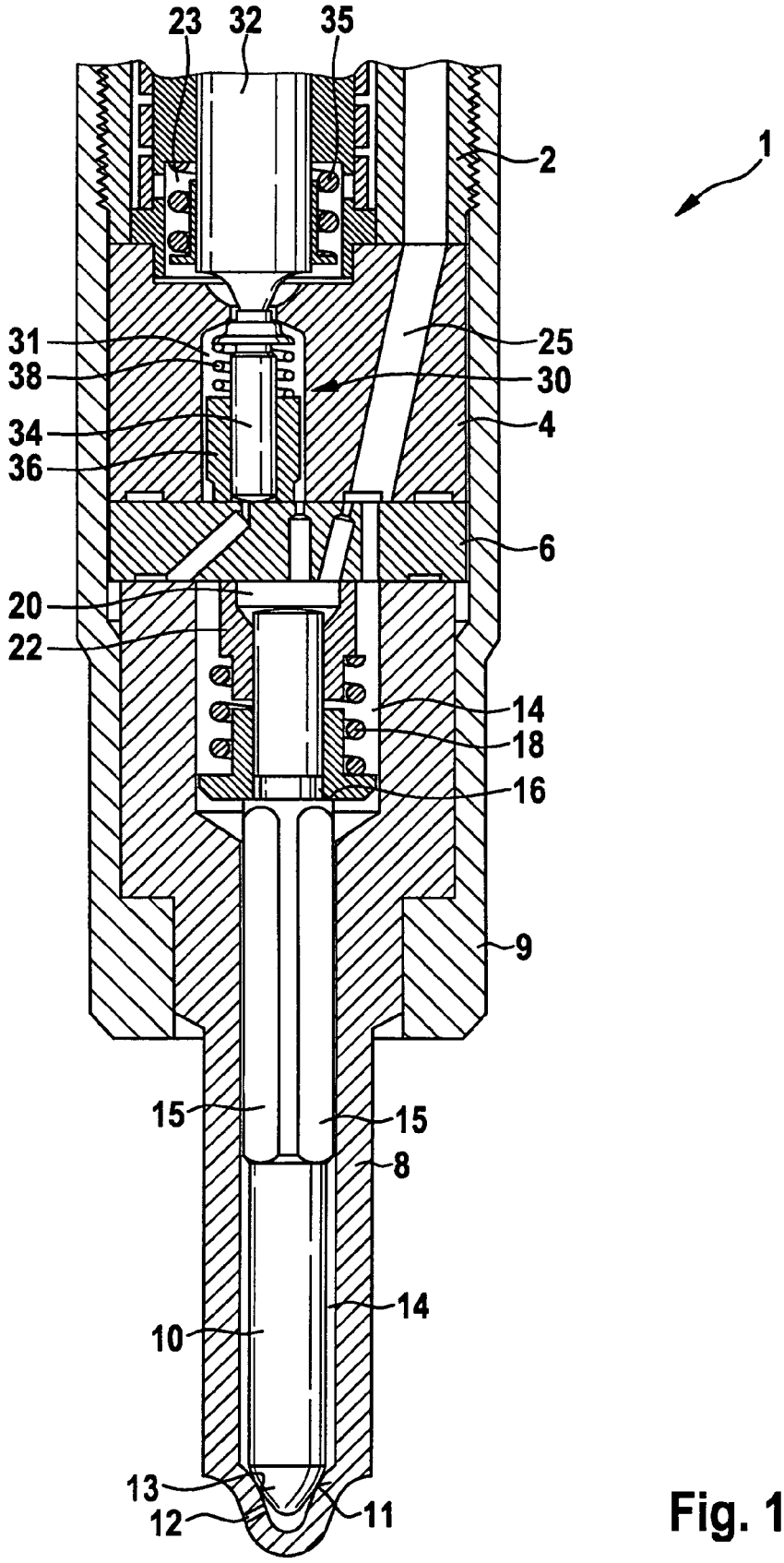
FIG. 1 shows a longitudinal section through a fuel injection valve of the invention, in which only the essential portions are shown.

FIG. 1 shows a fuel injection valve 1 according to the invention in longitudinal section. The fuel injection valve 1 has a retaining body 2, a valve body 4, a throttle disk 6, and a nozzle body 8, which contact one another in that order. The components are pressed against one another by a tensioning nut 9, which is braced on a shoulder of the nozzle body 8 and is retained on the retaining body 2 by means of a thread. In the nozzle body 8, a pressure chamber 14 is embodied, in which a pistonlike nozzle needle 10 is disposed longitudinally displaceably. The nozzle needle 10, on its end toward the combustion chamber, has a sealing face 11, with which it cooperates with a nozzle seat 13 that is embodied on the end of the pressure chamber 14 toward the combustion chamber. One or more injection openings 12 originate at the nozzle seat 13, and in the installed position of the fuel injection valve 1 they open directly into a combustion chamber of an internal combustion engine. The nozzle needle 10 is guided in a middle portion in the pressure chamber 14, and the fuel is carried through a plurality of polished faces 15 to the injection openings 12.

The nozzle needle 10 is guided, on its end remote from the valve seat, in a sleeve 22; the sleeve 22 is pressed against the throttle disk 6 by a closing spring 18, which surrounds the nozzle needle 10 and is braced, remote from the sleeve 22, on a shoulder 16. By means of the sleeve 22, the face end of the nozzle needle 10 remote from the valve seat, and the throttle disk 6, a control chamber 20 is defined, which is filled with fuel, so that by the pressure in the control chamber 20, a hydraulic force is exerted on the face end, remote from the valve seat, of the nozzle needle 10 and exerts a force on the nozzle needle 10 in the direction of the nozzle seat 13.

An inlet conduit 25 is embodied in the retaining body 2, the valve body 4, and the throttle disk 6, and by way of this conduit, compressed fuel is carried at high pressure from a high-pressure fuel source into the pressure chamber 14. As shown further enlarged in FIG. 2, the inlet conduit 25 communicates with the control chamber 20 via an inlet throttle restriction 40 extending in the throttle disk 6. Thus the same fuel pressure is always established between the high-pressure conduit 25 and the control chamber 20, with a certain time lag.

For controlling the fuel pressure in the control chamber 20, a control valve 30 is provided in the valve body 4; the control valve 30 has a control valve chamber 31, which is embodied as a hollow chamber in the valve body 4. The control valve chamber 31 communicates with the control chamber 20 in the nozzle body 8 via an outlet throttle restriction 42, which is embodied in the throttle disk 6. A control valve member 34 is disposed longitudinally displaceably in the control valve chamber 31, and the control valve member 34 has a pistonlike shape and, on its end remote from the throttle disk 6, a mushroom-shaped widened portion, on which a sealing face 52 is embodied, with which face the control valve member 34 cooperates with a first control valve seat 37 that is embodied on the inside of the control valve chamber 31.

The control valve member 34, on its end remote from the first control valve seat 37, is guided in a sleeve 36, which is braced by one end on the throttle disk 6, and between which and the control valve member 34, a spring 38 is disposed in pressure-prestressed fashion. By the force of the spring 38, on the one hand the control valve member 34 is pressed against the first control valve seat 37, and on the other the sleeve 36 is pressed against the throttle disk 6. The motion of the control valve member 34 in the control valve chamber 31 takes place via a piston 32, which is disposed in the retaining body 2 and is movable by an electrical actuator in its longitudinal direction, for instance by means of an electromagnet or a piezoelectric actuator. The piston 32 is located here in a leak fuel chamber 23, which is pressure-relieved at all times and has a low fuel pressure.

A low-pressure chamber 54, which is pressure-relieved at all times via a leak fuel outlet 45, is defined by the sleeve 36, the control valve member 34, and the throttle disk 6. The leak fuel outlet 45 can for instance act as a communication with the leak fuel chamber 23.

The mode of operation of the fuel injection valve is as follows: At the onset of the injection, the control valve member 34, driven by the spring 38, is in contact with the first control valve seat 37. The control valve chamber 31 communicates via the outlet throttle restriction 42 with the control chamber 20, which in turn communicates via the inlet throttle restriction 40 with the high-pressure conduit 25, so that a high fuel pressure, of the kind that also prevails in the inlet conduit 25, is established both in the control chamber 20 and in the control valve chamber 31. The low-pressure chamber 54 is without pressure, or is at only a very slight pressure, so that only slight forces on the control valve member 34 are exerted as a result of the pressure in the low-pressure chamber 54. By means of the fuel pressure in the control chamber 20, a hydraulic force in the direction of the nozzle seat 13 is exerted on the face end, remote from the valve seat, of the nozzle needle 10, and this force presses the nozzle needle 10 against the nozzle seat 13. Since the nozzle needle 10 is in contact with the nozzle seat 13, the pressure chamber 14 is sealed off from the injection openings 12, so that no fuel from the pressure chamber 14 can reach the combustion chamber of the engine. If an injection is to take place, then by means of an electrical actuator not shown in the drawings, the piston 32 is moved in the direction of the nozzle body 8, as a result of which the control valve member 34 moves away from the first control valve seat 37 into contact with the second control valve seat 39. As a result, a communication is triggered between the sealing face 52 of the control valve member 34 and the first control valve seat 37, and this communication connects the control valve chamber 31 with the leak fuel chamber 23, so that the pressure in the control valve chamber 31 rapidly drops. The replenishing fuel flowing into the control valve chamber 31 from the control chamber 20 via the outlet throttle restriction 42 also leads to a pressure drop in the control valve chamber 31; the outlet throttle restriction 42 and the inlet throttle restriction 40 are dimensioned such that more fuel flows away via the outlet throttle restriction 42 than flows in the same period of time from the high-pressure conduit 25 via the inlet throttle restriction 40. The decreasing fuel pressure in the control chamber 20 leads to a reduced hydraulic force on the end face of the nozzle needle 10 remote from the valve seat, so that the hydraulic forces which otherwise act on the nozzle needle 10, in particular on parts of the sealing face 11, cause the nozzle needle 10 to lift from the nozzle seat 13 and to move in the direction of the throttle disk 6, counter to the force of the spring 18. As a result, a gap is opened up between the sealing face 11 and the nozzle seat 13, and through this gap fuel flows out of the pressure chamber 14 to the injection openings 12 and is injected through the injection openings 12 into a combustion chamber of the engine. To terminate the injection, the electrical actuator is actuated once again, and the control valve member 34, via the piston 32, moves back into contact with the first control valve seat 37. Since the communication of the control valve chamber 31 with the leak fuel chamber 23 is now interrupted, a high fuel pressure rapidly builds up again in the control chamber via the inlet throttle restriction 40, and in the control valve chamber 31 as well, via the outlet throttle restriction 42.

The control valve member 34, on its sealing face 52, has a sealing edge 50, with which the control valve member 34 contacts the first control valve seat 37. The diameter of the sealing edge 50 is equivalent to the diameter of the control valve member 34, in the portion thereof that is guided in the sleeve 36. Since the fuel pressure of the control valve chamber 31 engages only the part of the sealing face 52 that is located radially outward from the sealing edge 50, this hydraulic force is compensated for by a corresponding contrary force on the underside of the mushroom-shaped widened portion of the control valve member 34, so that the control valve member 34 does not experience any hydraulic force operative in the direction of its longitudinal motion resulting from the fuel pressure in the control valve chamber 31 and is thus force-balanced.

Figure 2:
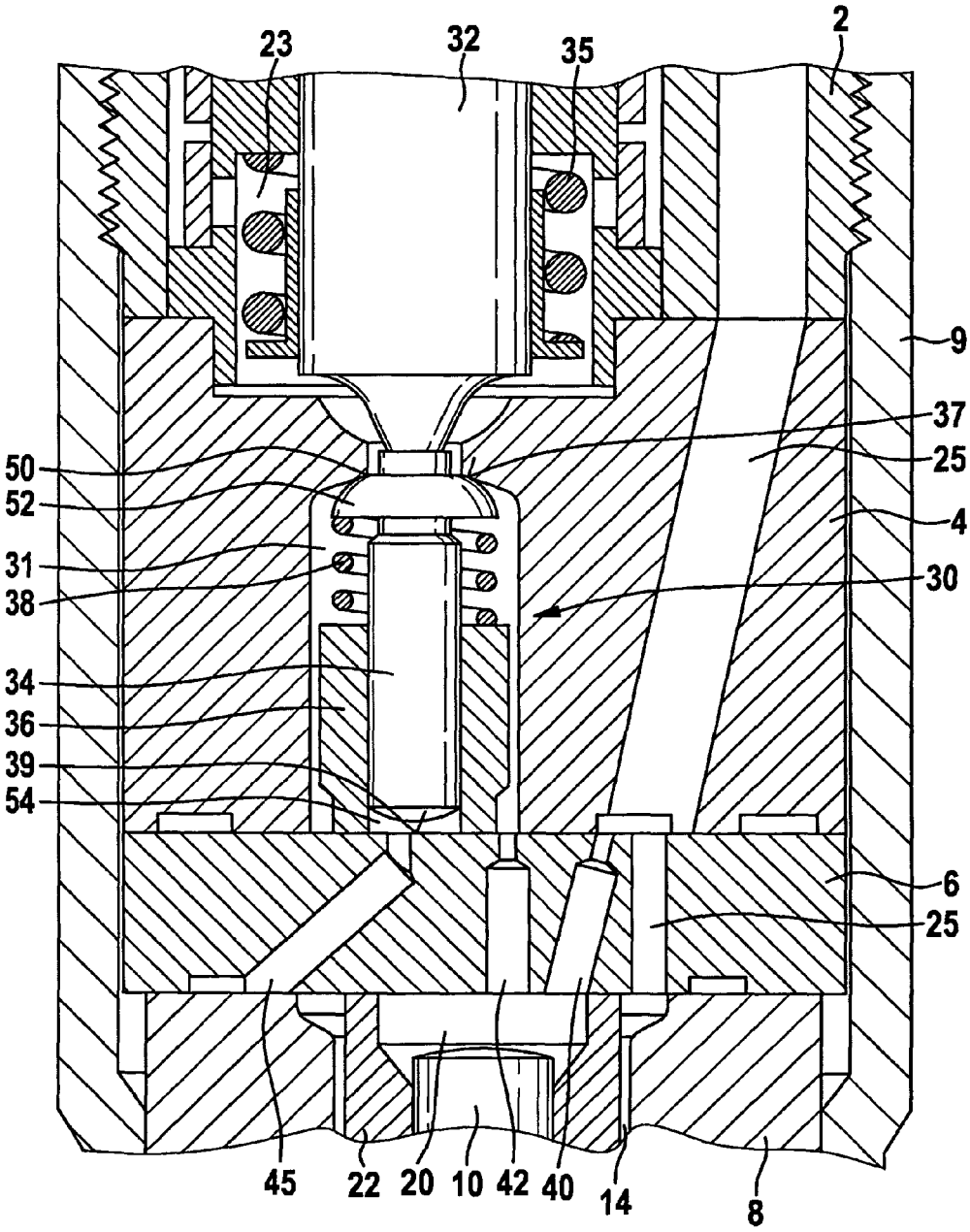
FIG. 2 is an enlarged view of the control valve of FIG. 1.
Figure 3:
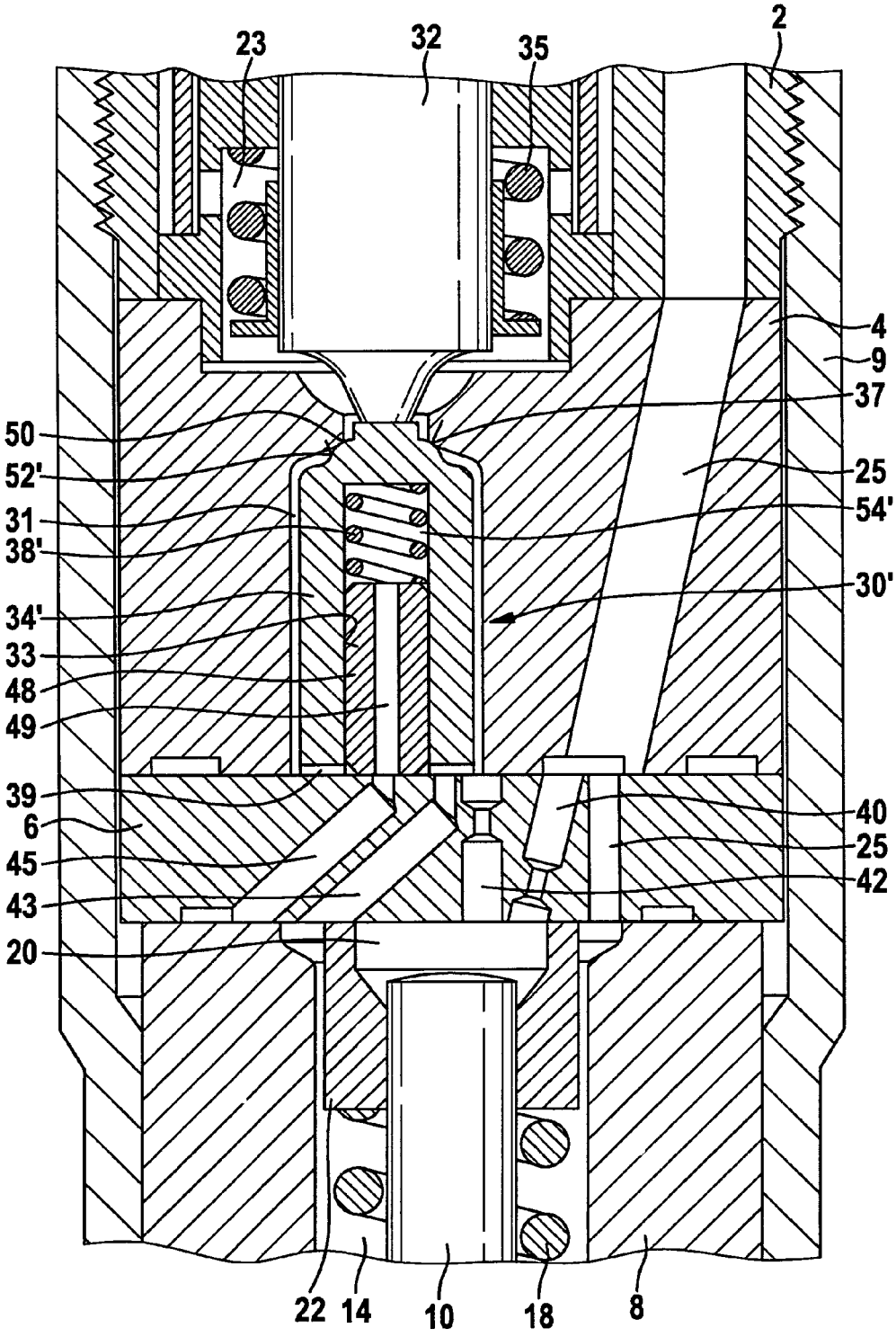
FIG. 3, in the same view as FIG. 2, shows a further exemplary embodiment of the fuel injection valve of the invention.

In FIG. 3, in the same view as in FIG. 2, a further exemplary embodiment of the control valve 30' is shown; identical elements are identified by the same reference numerals, and a more-detailed description of the parts that are identical to those in FIG. 2 will be dispensed with here. The control valve member 34' in this exemplary embodiment has a blind bore 33, whose open end faces away from the first control valve seat 37. In the blind bore 33, there is an inner sleeve 48, which has a longitudinal conduit 49 that extends over the entire length of the inner sleeve 48. By means of the inner sleeve 48 and the control valve member 34', a low-pressure chamber 54' is defined, in which a spring 38' is disposed. The spring 38' is disposed here in pressure-prestressed fashion and ensures that the inner sleeve 48 is pressed against the throttle disk 6, or in other words against the second control valve seat 39; the control valve member 34' is also pressed against the first control valve seat 37. Via the longitudinal bore 49, the low-pressure chamber 54' communicates with a leak fuel chamber 45, so that the interior of the control valve member 34', that is, the low-pressure chamber 54', is pressureless at all times.

To achieve the force equilibrium of the control valve member 34', the sealing edge 50 of the control valve member 34' is embodied such that it has the same diameter as the inner sleeve 48. In the closed state of the control valve 30', or in other words whenever the control valve member 34' is in contact with the first control valve seat 37, only the radially outer part of the sealing face 52' is subjected to the fuel pressure in the control valve chamber 31, which brings about a resultant hydraulic force in the direction of the second control valve seat 39. At the same time, however, the face of the control valve member 34' that is oriented toward the second control valve seat 39 is subjected to the fuel pressure in the control valve chamber 31 as well, so that the two hydraulic forces compensate for one another, and the control valve member 34' is force-balanced.

Otherwise, the function of the control valve 30' is identical to the exemplary embodiment shown in FIG. 2, with the exception of the bypass throttle restriction 43, which is additionally provided in the throttle disk 6. The bypass throttle restriction 43 connects the pressure chamber 14 to the control valve chamber 31, and the bypass throttle restriction 43 opens into the control valve chamber 31 in such a way that the bypass throttle restriction is closed by the control valve member 34' when the latter is in contact with the second control valve seat 39. As a result, with the control valve 30' open, the pressure reduction in the control chamber 20 is prevented from slowing down and thus leading to a delayed opening of the nozzle needle 10. Upon termination of the injection, or in other words once the control valve member 34' moves back into contact with the first control valve seat 37, however, the control valve chamber 31 is filled very quickly again with fuel at high pressure via the bypass throttle restriction 43, so that the control chamber 20 is filled very quickly with fuel at high pressure not only via the inlet throttle restriction 40 but also by the inflow of fuel from the control valve chamber 31 via the outlet throttle restriction 42, which leads to a fast closure of the nozzle needle 10. This is important particularly so that the fuel will not, because of a slowly closing nozzle needle 10 at low pressure, trickle through the injection openings 12 into the combustion chamber of the engine, which would lead to high-pollution combustion.

Figure 4:
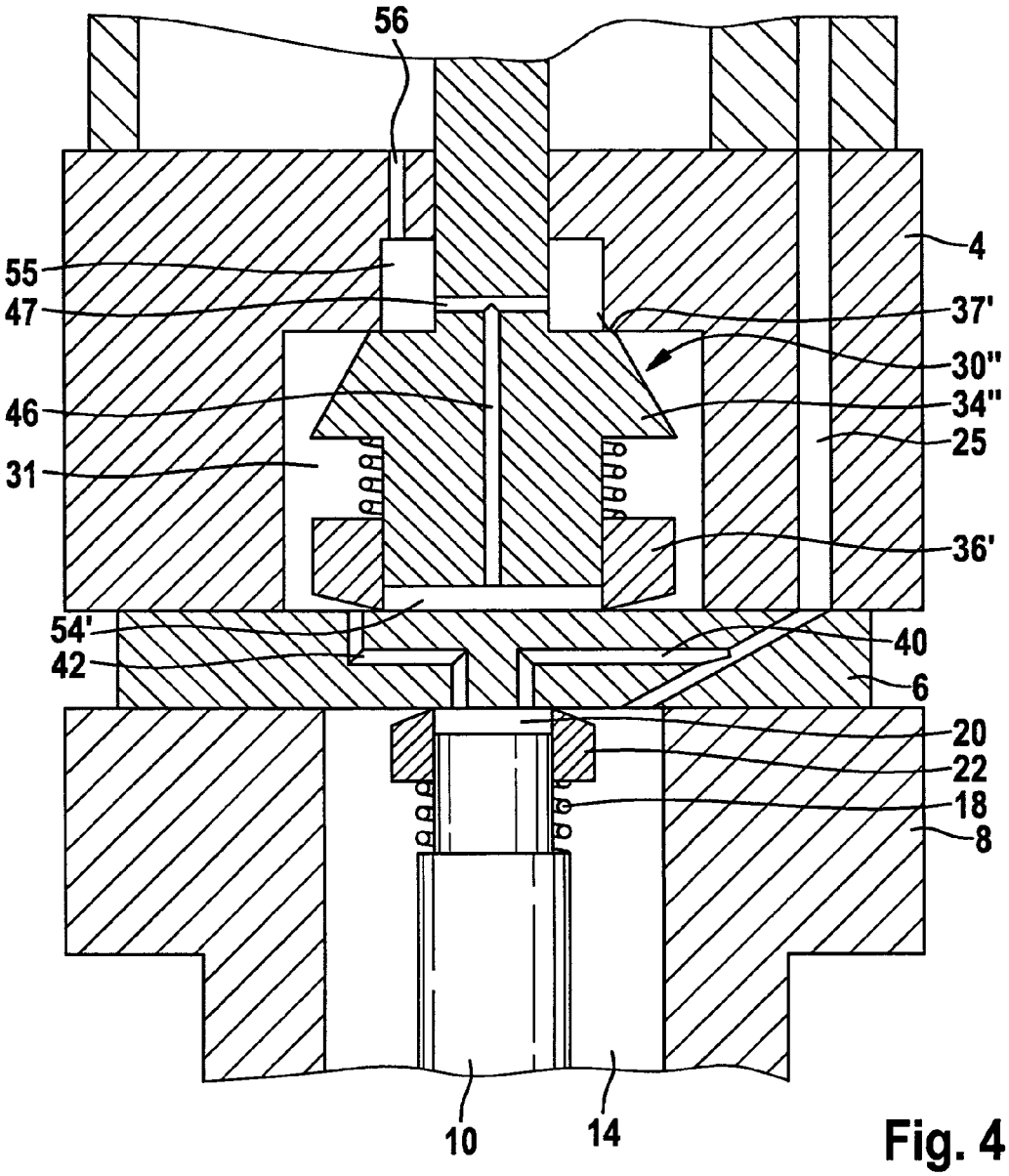
FIG. 4 schematically shows a further exemplary embodiment.

In FIG. 4, a further exemplary embodiment of the control valve 30" of the invention is shown. This illustration is schematic and differs from the control valve of FIG. 2 in that the low-pressure chamber 54 is not pressure-relieved via a leak fuel outlet 45 embodied in the throttle disk 6, but instead is pressure-relieved via a longitudinal conduit 46, extending in the control valve member 34", and a transverse conduit 47, intersecting the longitudinal conduit, that finally opens into an annular chamber 55 which is pressure-relieved via a leak fuel connection 56. The annular chamber 55 is located downstream of the first control valve seat 37', so that overall, the construction is simpler than when there is an additional leak fuel outlet 45 in the throttle disk 6 that must communicate with the leak fuel chamber 23 via an additional conduit in the valve body 4.

The foregoing relates to the preferred exemplary embodiments of the invention, it being understood that other variants and embodiments thereof are possible within the spirit and scope of the invention, the latter being defined by the appended claims.

The invention claimed is:

1. A fuel injection valve for internal combustion engines, for injecting fuel at high pressure, comprising:

a nozzle needle which by a longitudinal motion thereof cooperates with a valve seat and thereby opens and closes at least one injection opening, and the nozzle needle, as a result of pressure in a control chamber, experiences a closing force oriented in a direction of the valve seat; and a control valve, embodied in a valve body, by which control valve the pressure in the control chamber is adjustable, and the control valve includes a control valve chamber communicating with the control chamber, in which control valve chamber a control valve member is disposed longitudinally movably and by a longitudinal motion thereof opens and closes a communication of the control valve chamber with a leak fuel chamber, wherein the control valve member is surrounded by pressure in the control valve chamber and is embodied such that by the pressure in the control valve member, no or only a very slight resultant hydraulic force is exerted on the control valve member in a longitudinal direction of motion when the control valve member closes the communication of the control valve chamber with the leak fuel chamber.

2. The fuel injection valve as defined by claim 1, wherein the control valve member is embodied in pistonlike form and cooperates with a first control valve seat for opening and closing the communication of the control valve chamber with the leak fuel chamber.

3. The fuel injection valve as defined by claim 2, wherein the control valve member, on an end thereof remote from the first control valve seat, is guided in a sleeve, which defines a low-pressure chamber that is pressure-relieved at all times.

4. The fuel injection valve as defined by claim 3, wherein the control valve member has an encompassing sealing edge, with which the control valve member communicates with the first control valve seat.

5. The fuel injection valve as defined by claim 4, wherein a portion of the control valve member that is guided in the sleeve has at least approximately the same diameter as the sealing edge.

6. The fuel injection valve as defined by claim 3, wherein between the sleeve and the control valve member, a spring is disposed in prestressed fashion, such that the control valve member is pressed against the control valve seat.

7. The fuel injection valve as defined by claim 4, wherein between the sleeve and the control valve member, a spring is disposed in prestressed fashion, such that the control valve member is pressed against the control valve seat.

8. The fuel injection valve as defined by claim 5, wherein between the sleeve and the control valve member, a spring is disposed in prestressed fashion, such that the control valve member is pressed against the control valve seat.

9. The fuel injection valve as defined by claim 2, wherein the control valve member has a blind bore, which is open toward the end, remote from the control valve seat, of the control valve member.

10. The fuel injection valve as defined by claim 9, wherein an inner sleeve is disposed in the blind bore.

11. The fuel injection valve as defined by claim 10, wherein a spring is disposed in the blind bore in prestressed fashion, between the inner sleeve and the control valve member, in such a way that the control valve member is pressed by the spring against the first control valve seat.

12. The fuel injection valve as defined by claim 10, wherein the inner sleeve has a longitudinal bore, by way of which the blind bore communicates at all times with a leak fuel outlet.

13. The fuel injection valve as defined by claim 11, wherein the inner sleeve has a longitudinal bore, by way of which the blind bore communicates at all times with a leak fuel outlet.

14. The fuel injection valve as defined by claim 10, wherein the control valve chamber can be made to communicate with a fuel high pressure-carrying region of the fuel injection valve via a bypass throttle restriction.

15. The fuel injection valve as defined by claim 11, wherein the control valve chamber can be made to communicate with a fuel high pressure-carrying region of the fuel injection valve via a bypass throttle restriction.

16. The fuel injection valve as defined by claim 12, wherein the control valve chamber can be made to communicate with a fuel high pressure-carrying region of the fuel injection valve via a bypass throttle restriction.

17. The fuel injection valve as defined by claim 13, wherein the control valve chamber can be made to communicate with a fuel high pressure-carrying region of the fuel injection valve via a bypass throttle restriction.

18. The fuel injection valve as defined by claim 14, wherein the control valve member, on contacting the control valve seat, opens the bypass throttle restriction, and for opening the communication between the control valve chamber and the leak fuel chamber closes the bypass throttle restriction by a longitudinal motion thereof, in that the control valve member comes to contact a second control valve seat.

19. The fuel injection valve as defined by claim 18, wherein the control valve member, in an open position thereof, comes to contact a second control valve seat embodied on the throttle disk.

20. The fuel injection valve as defined by claim 3, wherein the low-pressure chamber is pressure-relieved via a conduit extending in the control valve member.

* * * * *

UNITED STATES PATENT AND TRADEMARK OFFICE

CERTIFICATE OF CORRECTION

PATENT NO. : 8,662,411 B2
APPLICATION NO. : 12/736635
DATED : March 4, 2014
INVENTOR(S) : Andreas Gruenberger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 674 days.

Signed and Sealed this
Twenty-ninth Day of September, 2015

Michelle K. Lee

Michelle K. Lee
*Director of the United States Patent and Trademark Office*